US009387670B1

(12) United States Patent
Kelly, III et al.

(10) Patent No.: US 9,387,670 B1
(45) Date of Patent: Jul. 12, 2016

(54) CONTROLLING A PRINTING SYSTEM USING ENCODER RATIOS

(71) Applicant: Eastman Kodak Company, Rochester, NY (US)

(72) Inventors: Gerald L. Kelly, III, Byron, NY (US); Rodney Gene Mader, Springfield, OH (US); Brian L. Travis, BeaverCreek, OH (US); Timothy John Young, Williamson, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/751,190

(22) Filed: Jun. 26, 2015

(51) Int. Cl.
*B41J 29/38* (2006.01)
*B41J 2/045* (2006.01)

(52) U.S. Cl.
CPC ..... *B41J 2/04573* (2013.01)

(58) Field of Classification Search
CPC ... B41J 11/42; B41J 29/393; B41J 2029/3935
See application file for complete search history.

(56) References Cited

U.S. PATENT DOCUMENTS 4,572,752 A * 2/1986 Jensen ..... B32B 27/10 156/361
4,945,293 A * 7/1990 Wittkopf ..... B41F 13/02 318/12
6,068,362 A 5/2000 Dunand et al.
7,665,817 B2 2/2010 Folkins
7,857,414 B2 * 12/2010 Eun et al. ..... 347/19
7,871,145 B1 1/2011 Enge
8,123,326 B2 2/2012 Saettel et al.
8,136,907 B2 3/2012 Eun et al.
8,251,504 B2 8/2012 Viturro et al.
8,303,071 B2 11/2012 Eun
8,346,503 B2 1/2013 Eun et al.
8,529,007 B2 9/2013 Folkins et al.
8,760,712 B2 6/2014 Enge et al.
8,842,331 B1 9/2014 Enge
8,876,277 B2 11/2014 Vandagriff et al.
2012/0219342 A1 * 8/2012 Peter ..... B41J 11/0035 400/578
2014/0049575 A1 * 2/2014 Leighton et al. ..... 347/14

FOREIGN PATENT DOCUMENTS

EP 0729846 1/2000

* cited by examiner

*Primary Examiner* — Stephen Meier
*Assistant Examiner* — John P Zimmermann
(74) *Attorney, Agent, or Firm* — Kevin E. Spaulding

(57) ABSTRACT

A method for adjusting an encoder pulse count delay in a printing system for printing on a continuous web of print media using first and second printheads. First and second encoders are provided at different positions along the media transport path. An initial encoder pulse count delay is provided for use in printing with the second printhead. An initial ratio of the first encoder pulse rate to the second encoder pulse rate is determined. At a subsequent time a subsequent ratio of the first encoder pulse rate to the second encoder pulse rate is determined. An adjusted encoder pulse count delay is determined by adjusting the initial encoder pulse count delay responsive to the initial ratio and the subsequent ratio and used to control printing by the second printhead.

15 Claims, 8 Drawing Sheets

CONTROLLING A PRINTING SYSTEM USING ENCODER RATIOS

FIELD OF THE INVENTION

This invention pertains to the field of digital printing and more particularly to a method for adjusting the timing at which image data is printed.

BACKGROUND OF THE INVENTION

In a digitally-controlled printing system, a print medium is directed through a series of components. The print medium can be cut sheets of media or a continuous web of media. For inkjet printing systems, as the print medium moves through the printing system, liquid, for example, ink, is applied to the print medium using one or more printheads. This is commonly referred to as jetting of the ink.

In commercial inkjet printing systems, the print medium is physically transported through the printing system at a high rate of speed. For example, the print medium can travel 650 to 1000 feet per minute. The printheads in commercial inkjet printing systems typically include multiple jetting modules that jet ink onto the print medium as the print medium is being physically moved through the printing system. A reservoir containing ink or some other material is typically positioned behind each nozzle plate in a printhead. The ink streams through the nozzles in the nozzle plates when the reservoirs are pressurized.

The jetting modules in each printhead in commercial printing systems typically jet only one color. Thus, when different colored inks are used to print color image content there is generally a printhead for each colored ink. For example, there are four printheads in printing systems using cyan, magenta, yellow and black colored inks. The content is printed by jetting the colored inks sequentially. Each colored ink deposited on the print medium is known as a color plane. The color planes need to be aligned, or registered with each other, so that the overlapping ink colors produce a quality single image. It is also necessary for the print swaths of the multiple jetting modules to be stitched together without visible seams.

There are several variables that contribute to the registration errors and to stitching errors including physical properties of the print medium, means of conveyance of the print medium, ink application system, ink coverage, and drying of ink. There is a need for improved methods to provide good color-to-color registration and good print swath stitching.

SUMMARY OF THE INVENTION

The present invention represents a method for adjusting an encoder pulse count delay in a printing system for printing on a continuous web of print media, comprising:

providing a first printhead at a first printhead position along a media transport path, the first printhead being adapted to print ink drops onto the print media as the print media travels along the media transport path past the first printhead position;

providing a second printhead at a second printhead position along the media transport path, the second printhead being adapted to print ink drops onto the print media as the print media travels along the media transport path past the second printhead position;

providing a first encoder at a first encoder position along the media transport path, the first encoder generating a first encoder pulse stream having a first encoder pulse rate, each pulse in the first pulse stream indicating the passage of a first defined length of print media past the first encoder position, wherein the first pulse stream controls a timing for printing of ink drops from the first printhead;

providing a second encoder at a second encoder position along the media transport path, the second encoder generating a second encoder pulse stream having a second encoder pulse rate, each pulse in the second pulse stream indicating the passage of a second defined length of print media past the second encoder position, wherein the second pulse stream controls a timing for printing of ink drops from the second printhead;

determining an initial ratio of the first encoder pulse rate to the second encoder pulse rate;

providing an initial encoder pulse count delay for use in printing with the second printhead;

controlling the first printhead responsive to the first encoder pulse stream to print ink drops on the print media in accordance with image data for a first image plane of a first printed image;

controlling the second printhead responsive to the second encoder pulse stream and the initial encoder pulse count delay to print ink drops on the print media in accordance with image data for a second image plane of the first printed image;

determining a subsequent ratio of the first encoder pulse rate to the second encoder pulse rate;

using a processor to determine an adjusted encoder pulse count delay by adjusting the initial encoder pulse count delay responsive to the initial ratio and the subsequent ratio;

controlling the first printhead responsive to the first encoder pulse stream to print ink drops on the print media in accordance with image data for a first image plane of a second printed image;

controlling the second printhead responsive to the second encoder pulse stream and the adjusted encoder pulse count delay to print ink drops on the print media in accordance with image data for a second image plane of the second printed image.

This invention has the advantage that it provides compensation for any drift in the second encoder pulse rate over time due to sources such as thermally-induced changes in the diameter of the encoder roller.

It has the additional advantage that stitching errors between different jetting modules of a printhead will be reduced.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
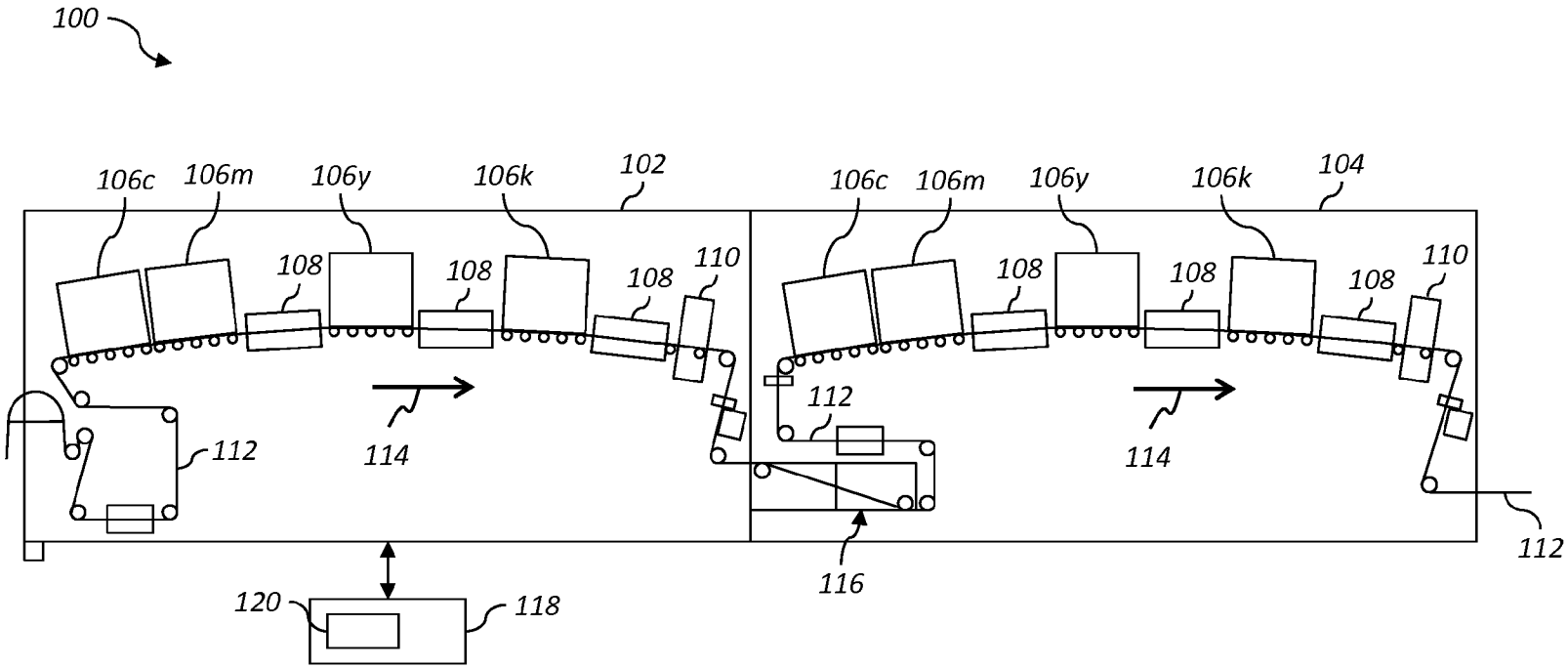
FIG. 1 is a schematic of a continuous web inkjet printing system.

The present description will be directed in particular to elements forming part of, or cooperating more directly with, apparatus in accordance with the present invention. It is to be understood that elements not specifically shown or described may take various forms well known to those skilled in the art.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the elements of the invention is not limiting. It should be noted that, unless otherwise explicitly noted or required by context, the word "or" is used in this disclosure in a non-exclusive sense.

Throughout the specification and claims, the following terms take the meanings explicitly associated herein, unless the context clearly dictates otherwise. Additionally, directional terms such as "on", "over", "top", "bottom", "left", "right" are used with reference to the orientation of the figure(s) being described. Because components of aspects of the present invention can be positioned in a number of different orientations, the directional terminology is used for purposes of illustration only and is in no way limiting.

As described herein, the example aspects of the present invention are applied to color plane registration in inkjet printing systems. However, many other applications are emerging which use inkjet jetting modules or similar nozzle arrays to emit fluids (other than inks) that need to be finely metered and deposited with high spatial precision. Such liquids include inks, both water-based and solvent-based, that include one or more dyes or pigments. These liquids also include various substrate coatings and treatments, various medicinal materials, and functional materials useful for forming, for example, various circuitry components or structural components. In addition, a nozzle array can jet out gaseous material or other fluids. As such, as described herein, the terms "liquid" and "ink" refer to any material that is ejected by a nozzle array. For simplicity and clarity of description, the invention will be described in terms of a multi-color inkjet printer. It must be understood that the invention similarly applies to other applications such as the printing of multiple layers of an electronic circuit where the individual circuit layers would correspond to an image plane in the color printer. In such applications, registration of the individual layers must be maintained for proper operation of the electronic circuit in a similar manner to the registration of the color image planes in the color prints. It is anticipated that many other applications may be developed in which the invention may be employed to enhance the registration of the image planes.

Inkjet printing is commonly used for printing on paper. However, printing can occur on any type of substrate or receiver medium. For example, the print medium can include vinyl sheets, plastic sheets, glass plates, textiles, paperboard, and corrugated cardboard. Additionally, although the term inkjet is often used to describe the printing process, the term jetting is also appropriate wherever ink or other fluid is applied in a consistent, metered fashion, particularly if the desired result is a thin layer or coating.

Inkjet printing is a non-contact application of an ink to a print medium. Typically, one of two types of ink jetting mechanisms are used and are categorized by technology as either drop-on-demand ink jet or continuous ink jet. The first technology, drop-on-demand ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil it, forming a vapor bubble that creates enough internal pressure to eject an ink drop. This form of inkjet is commonly termed thermal ink jet.

The second technology, commonly referred to as continuous ink jet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting drops so that printing drops reach the print medium and non-printing drops are caught by a collection mechanism. Various approaches for selectively deflecting drops have been developed including electrostatic deflection, air deflection, and thermal deflection.

The present invention described herein is applicable to both types of inkjet printing technologies. As such, the terms printhead and jetting module, as used herein, are intended to be generic and not specific to either technology. Additionally, the present invention described herein is applicable to a wide variety of types of print medium. As such, the terms print medium, and web, as used herein, are intended to be generic and not as specific to one type of print medium or web, or the way in which the print medium or web is moved through the printing system. Additionally, the terms printhead, jetting module, print medium, and web can be applied to other non-traditional inkjet applications, such as printing conductors on plastic sheets.

The terms "color plane" and "image plane" are used generically and interchangeably herein to refer to a portion of the data that is used to specify the location of features that are made by a particular station of a digitally controlled printing system on the print medium. Similarly, "color-to-color registration" is used generically herein to refer to the registration of such features that are made by different stations on the print medium. For color printing of images, the patterns of dots printed by different printheads in printing the same or different colors must be registered with each other to provide a high quality image. An example of a non-color printing application is functional printing of a circuit. The patterns of dots printed by different printheads, the image planes, form directly or serve as catalysts or masks for the formation of different layers of deposited materials such as conductive materials, semiconductor materials, resistive materials, insulating materials of various dielectric constants, high permeability magnetic materials, or other types of materials. In this case, the deposited materials must also be registered to provide a properly functioning circuit. The terms color plane and color-to-color registration can also be used herein to refer to the mapping and registration of pre-print or finishing operations, such as the mapping of where the folds or cutting or slitting lines are, or the placement of vias in an electrical circuit.

The term "print swath" corresponds to the portion of the printed image printed by a single jetting module during a single pass of the print media by the jetting module. Adjacent print swaths are to be printed in a manner that the transition between the swath printed by one jetting module to the swath printed by another jetting module produces no visual discernable artifact. The process which enables this is referred to as stitching. Commonly-assigned U.S. Pat. No. 7,871,145 to Enge, entitled "Printing method for reducing stitch error between overlapping jetting modules," discloses an effective method for stitching the print swaths together.

The terms "upstream" and "downstream" are terms of art referring to relative positions along the transport path of the print medium; the print media moves along the transport path from upstream to downstream. In FIGS. 1-4 print medium 112 moves in a direction indicated by transport direction 114. Where they are used, terms such as "first", "second", and so on, do not necessarily denote any ordinal or priority relation, but are simply used to more clearly distinguish one element from another.

The schematic side view of FIG. 1 shows one example of a continuous web inkjet printing system 100. Printing system 100 includes a first printing module 102 and a second printing module 104, each of which includes printheads 106*c*, 106*m*, 106*y*, 106*k*, dryers 108, and a quality control sensor 110. Each printhead 106*c*, 106*m*, 106*y*, 106*k* typically includes multiple jetting modules (not shown in FIG. 1) that apply ink or another fluid (gas or liquid) to the surface of the print medium 112 that is adjacent to the jetting modules. In the illustrated configuration, each printhead 106*c*, 106*m*, 106*y*, 106*k* applies a different colored ink to the surface of the print medium 112. By way of example only, printhead 106*c* applies cyan colored ink, printhead 106*m* applies magenta colored ink, printhead 106*y* applies yellow colored ink, and printhead 106*k* applies black colored ink.

The first printing module 102 and the second printing module 104 also include a web tension system that serves to physically move the print medium 112 through the printing system 100 in the transport direction 114 (generally left-to-right as shown in the figure). The print medium 112 enters the first printing module 102 from a source roll (not shown) and the printhead 106*c*, 106*m*, 106*y*, 106*k* of the first printing module 102 apply ink to one side of the print medium 112. As the print medium 112 feeds into the second printing module 104, a turnover module 116 is adapted to invert or turn over the print medium 112 so that the printhead 106*c*, 106*m*, 106*y*, 106*k* of the second printing module 104 can apply ink to the other side of the print medium 112. The print medium 112 then exits the second printing module 104 and is collected by a print medium receiving unit (not shown).

One or more processors 118 can be connected to components in printing system 100 using any known wired or wireless communication connection. Processor 118 can be separate from printing system 100 or integrated within printing system 100 or within a component in printing system 100. Processor 118 can be a single processor or one or more processors. Each of the one or more processors can be separate from the printing system 100 or integrated within the printing system 100. The processor 118 can be used to control various components of the printing system 100. For example, processor 118 can be connected to the printhead 106*c*, 106*m*, 106*y*, 106*k* and can control the printing of appropriate image data. Processor 118 can also be connected to various components in the web tension system and used to control the positions of those components, such as gimbaled or caster rollers. Processor 118 can also be connected to the quality control sensor 110 and used to process images or data received from the quality control sensor 110.

One or more storage devices 120 are generally connected to the processor 118. The storage device 120 can store color plane correction values according to an aspect of the invention. The storage device 120 can be implemented as one or more external storage devices, one or more storage devices included within the processor 118, or a combination thereof. The storage device can include its own processor and can have memory accessible by the one or more processors 118.

Figure 2:
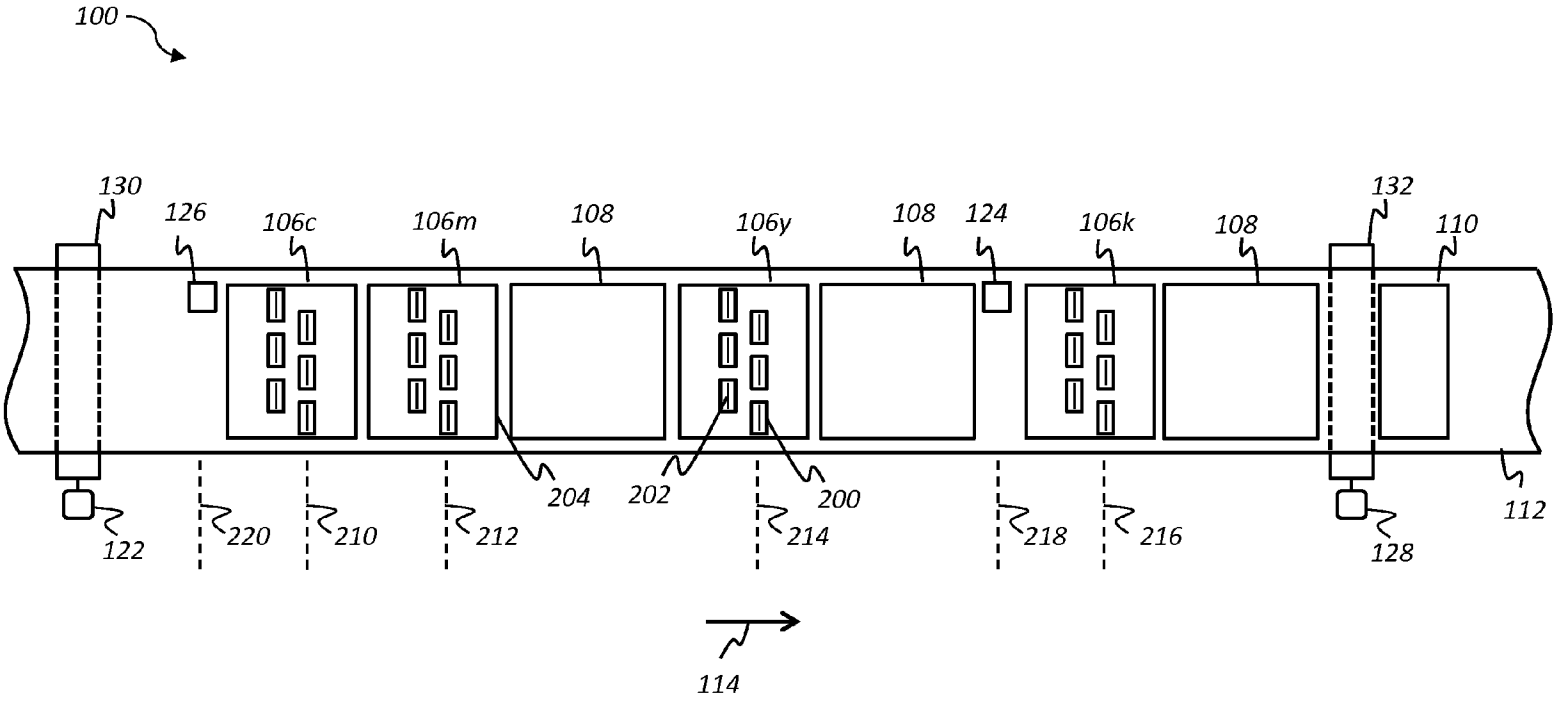
FIG. 2 is a schematic showing additional details of a portion of the printing system of FIG. 1.

FIG. 2 illustrates a portion of printing system 100, showing additional details. As the print medium 112 is moved through printing system 100, the printheads 106*c*, 106*m*, 106*y*, 106*k*, which typically include a plurality of jetting modules 200 having nozzle arrays 202. The jetting modules 200 apply ink or another fluid onto the print medium 112 via the nozzle arrays 202. The jetting modules 200 within each printhead 106*c*, 106*m*, 106*y*, 106*k* are located and aligned by a support structure 204 in the illustrated configuration. After the ink is jetted onto the print medium 112, the print medium 112 passes beneath the one or more dryers 108 which apply heat or air to the ink on the print medium 112. The operation of the printheads 106*c*, 106*m*, 106*y*, 106*k* is controlled by the processor 118 (FIG. 1) which receives signals related to the passage of the print medium 112 along the transport path from encoders 122, 128 and from one or more cue sensors 124, 126. FIG. 2 also includes references lines adjacent to the transport path of the print media. Reference lines 210, 212, 214, 216 correspond to the locations along the transport path at which the printheads 106*c*, 106*m*, 106*y*, and 106*k* complete the printing of the first, second, third, and fourth image planes, respectively, and reference lines 218 and 220 correspond to the locations along the transport at which cue marks 320 (FIG. 3-4) are detected by the cue sensors 124 and 126, respectively.

Figure 3:
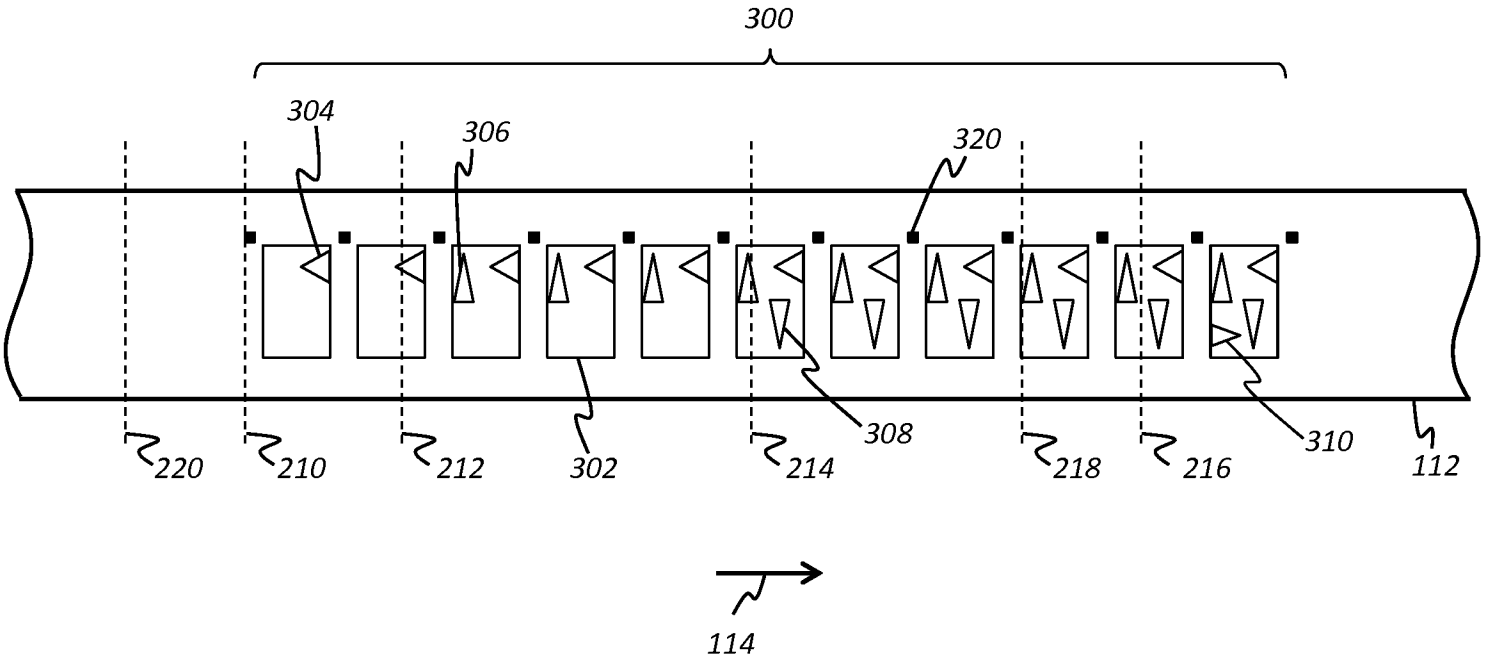
FIG. 3 illustrates a portion of a print job including a number of documents according to an aspect of the invention.

FIG. 3 illustrates the sequential nature of the printing of image planes for document pages 302 of a print job 300 on the print medium 112 as it moves along the transport path. Preprinted cue marks 320 can be detected by cue sensors 124, 126 (FIG. 2) at locations denoted by reference lines 218, 220, respectively. On print medium 112 lacking cue marks, the cue marks can be printed by the first printhead 106*c* at locations defined by a virtual cue. The virtual cue is a signal generated by the processor typically at defined cue intervals counted out in encoder pulses. The cue interval for the virtual cue is typically defined so that the cue marks 320 printed by the first printhead 106*c* are spaced out slightly longer than the length of the document pages 302 to be printed.

A first image plane 304 is printed by the first printhead 106*c* at a desired location on the print medium 112 relative to an associated cue mark 320 as the print medium 112 passes the first printhead 106*c* (FIG. 2), whose location corresponds to reference line 210. As the print medium 112 proceeds down the transport path and passes the second printhead 106*m* (FIG. 2), whose location corresponds to reference line 212, a second image plane 306 is printed on the print medium 112. Likewise, a third image plane 308 is printed on the print medium 112 as it passes the third printhead 106*y* (FIG. 2), whose location corresponds to reference line 214, and a fourth image plane 310 is printed on the print medium 112 as it passes the fourth printhead 106*k* (FIG. 2), whose location corresponds to reference line 216.

Returning to a discussion of FIG. 2, as the print medium 112 moves along the transport path its position is monitored to enable the processor 118 (FIG. 1), also known as a control system, to control the operation of the printheads 106*c*, 106*m*, 106*y*, 106*k* so that the image planes 304, 306, 308, 310 (FIG.

3) can be properly registered. Encoder 122 is used to monitor and provide an indication of the position of the print medium 112 as it passes along the transport path. In an exemplary configuration, the encoder 122 is a rotary encoder attached to a roller 130 over which the print medium 112 rolls. Such rotary encoders produce a defined number of electronic pulses per revolution of the roller 130. Through the appropriate selection of the attached roller diameter, such rotary encoders produce a predefined number of encoder pulses per print pixel spacing. A counting of encoder pulses as the print medium 112 moves through the printing module enables the processor 118 (FIG. 1) to track the motion of the print medium 112 as it passes along the transport path past the printheads 106*c*, 106*m*, 106*y*, 106*k*. It has been common therefore to delay the printing of the image data for the downstream printheads 106*m*, 106*y*, 106*k* relative to the most upstream printhead 106*c* by the number of encoder pulses that corresponds to the transport path spacing between the upstream printhead 106*c* and the downstream printheads 106*m*, 106*y*, 106*k*. For example, if the second printhead 106*m* is spaced 15 inches downstream of the first printhead 106*c*, and the encoder 122 produces 1000 pulses per inch of travel, then a 15×1000=15,000 encoder pulse delay would be applied for printing with the second printhead 106*m* relative to the printing of the corresponding image data with the first printhead 106*c*.

When the print job 300 (FIG. 3) is printed, the print medium 112 can receive varying amounts of ink during printing depending on the image content. In turn, the aqueous component of the ink is absorbed into the print medium 112 and can cause the print medium 112 to swell and stretch, especially with water-based ink in high ink laydown regions of the printed image content, and if the print medium 112 is under tension. Stretch can be higher in the direction of movement (i.e., the in-track or transport direction 114) than in the cross-track direction. Ink dryers 108 along the transport path then remove moisture from the print medium 112 causing the print medium to shrink. When the print medium 112 is heated in between printheads 106*m*, 106*y*, 106*k*, regions of the print medium 112 can be stretched and shrunk one or more times as the print medium 112 moves through the printing system.

As the print medium 112 undergoes stretch or shrinkage in the in-track or transport direction 114, the number of encoder pulses required for a point on the print medium 112 to move from the first printhead 106*c* to one of the downstream printheads 106*m*, 106*y*, 106*k* can deviate from normal. This can cause the image planes 306, 308, 310 printed by the printheads 106*m*, 106*y*, 106*k* to be misregistered relative to the image plane 304 printed by the first printhead 106*c*. Such misregistration can produce a loss of color registration and can lead to blurry content or hue degradation. In high speed inkjet printers, the spacing of the printheads 106*c*, 106*m*, 106*y*, 106*k* along the transport path can become quite large, such as the distance of 3.6 meters between the first printhead 106*c* and the fourth printhead 106*k* in the Kodak® Prosper® 6000 printer. With such a large distance, even a small fractional change in length of print medium 112 can result in registration shifts of many pixels between the image planes 304, 310 printed by the first printhead 106*c* and the last printhead 106*k*. Additionally, printing on both sides of the print medium 112 usually requires front-to-back registration, and the second side of the print medium 112 is usually printed significantly downstream of the first side.

With reference to FIGS. 2-3, to overcome this problem, some prior art systems time the printing of document pages 302 by some or all of the printheads 106*c*, 106*m*, 106*y*, 106*k* from the detection of a cue mark 320 printed on the print medium 112 by a cue sensor 124 associated with the printhead 106*c*, 106*m*, 106*y*, 106*k*. For example, the print timing of printhead 106*k* can be controlled relative to the detection of a cue mark 320 on the print medium 112 by cue sensor 124, which is located slightly upstream of the printhead 106*k*. Printhead 106*k* begins the printing of image plane 310 of document page 302 at an appropriate encoder pulse count delay, sometimes referred to as a cue delay or a registration encoder pulse count delay, from the cue pulse signaling the detection of cue mark 320 by the cue sensor 124. The encoder pulse count delay depends in part on the distance between the cue sensor and the associated printhead 106*k*. As this distance is much smaller than the distance between the first printhead 106*c* and the last printhead 106*k*, this process is much less sensitive to in-track dimensional changes of the print medium 112 than systems that base the control the print timing of the printhead 106*k* relative to the detection of a cue mark 320 by the upstream cue sensor 126 or on the print time of the most upstream printhead 106*c*. In the configuration of FIG. 2, only two cue sensors 124, 126 are used for each printing module. The printheads 106*c*, 106*m*, which print cyan and magenta respectively, receive their cue signals from cue sensor 126, and the printheads 106*y*, 106*k*, which print yellow and black respectively, receive their cue signals from cue sensor 124. In alternate configurations, additional cue sensors can also be positioned along the transport path upstream of printheads 106*m* and 106*y* so that each printhead 106*c*, 106*m*, 106*y*, 106*k* can be controlled based on a cue signal from an associated cue sensor located in close proximity.

Figure 4:
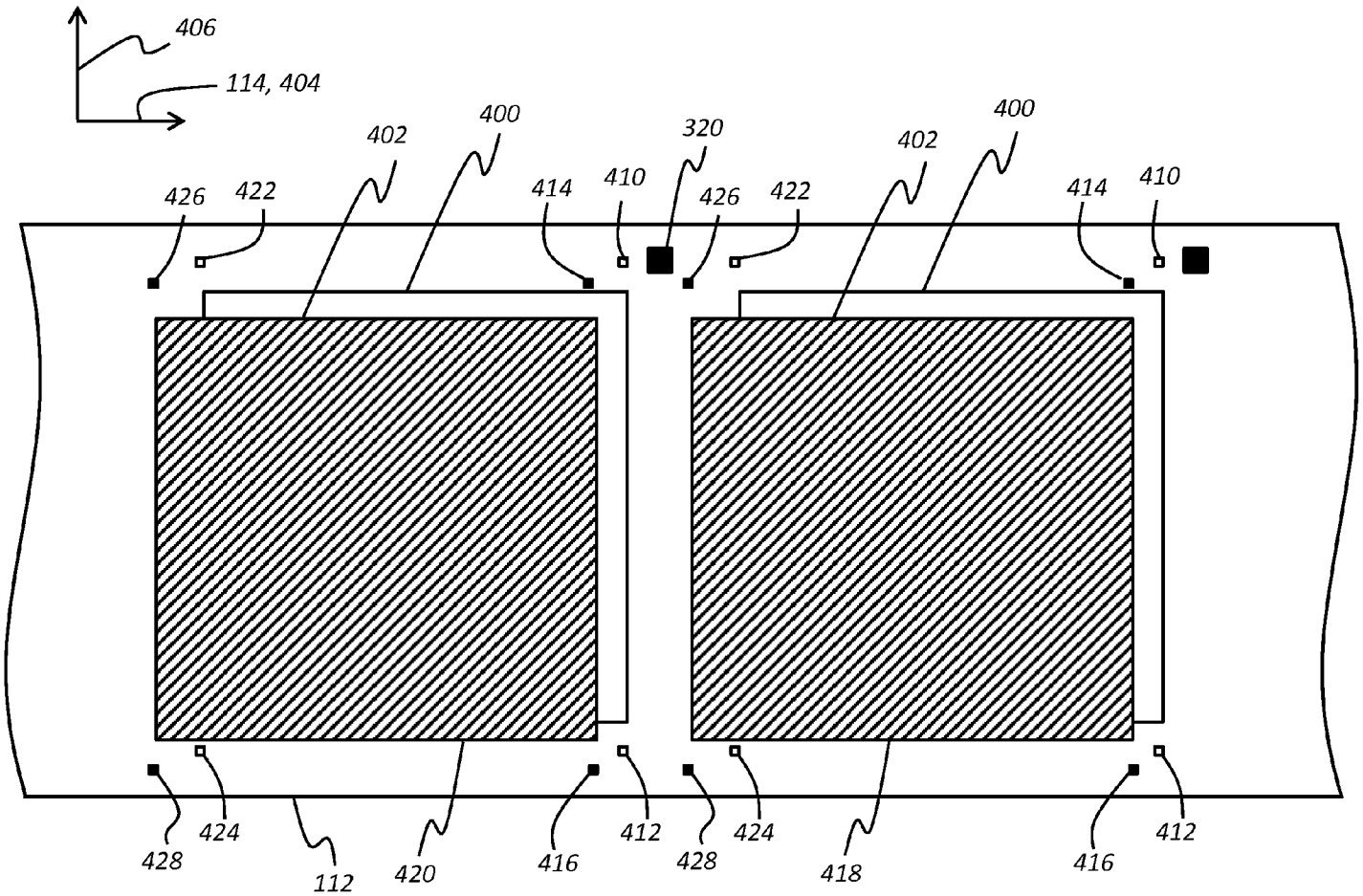
FIG. 4 illustrates the registration of two image planes of a portion of a print job according to an aspect of the invention.

FIG. 4 depicts an example of color registration errors between two color planes 400, 402 for two documents 418, 420. Typically, one color plane 400 is used as a reference from which the color registration errors are measured. Relative translation is one type of color registration error. By way of example only, the reference color plane 400 can be black. Errors in registration for the remaining color planes 402 can be determined by comparing them to the reference color plane 400. In this example, color plane 402 is shifted or translated with respect to the reference color plane 400, with color plane 402 having color registration errors in both the in-track direction 404 and the cross-track direction 406.

Not only is the color plane 402 displaced relative to color plane 400, but due to dimensional change in the print medium 112 between the printing of the two color planes 400, 402, color plane 402 is also changed dimensionally when compared to color plane 400. In this example, color plane 402 has shrunk in the cross-track direction 406 and expanded in the in-track direction 404 when compared to color plane 400.

The registration shifts and dimensional changes between the color planes 400, 402 are typically detected by detecting the position of registration marks associated with each color plane 400, 402. In this example, color plane 400 includes registration marks 410, 412, 422, and 424 and color plane 402 includes registration marks 414, 416, 426, and 428. By comparing the measured position of registration mark 414 relative to registration mark 410 to the nominal relative position of these two marks, in-track and cross-track displacement of the color plane 402 relative to the reference color plane 400 can be determined. By comparing the cross-track spacing of registration marks 414 and 416 of color plane 402 to the cross-track spacing of registration marks 410 and 412 of the reference color plane 400, the cross-track dimensional change of color plane 402 relative to the reference color plane 400 can be determined. By comparing the in-track spacing between the registration marks 414 and 426 associated with the leading and trailing edge of a document in color plane 402 to the in-track spacing between the corresponding registration marks 410 and 422 in the reference color plane 400, the in-track dimensional change of color plane 402 relative to the reference color plane 400 can be determined.

In a preferred embodiment, an image quality system is used to capture images of the registration marks 410, 412, 414, 416, 422, 424, 426, 428. The captured images are analyzed using well-known image processing methods to determine the positions of the registration marks 410, 412, 414, 416, 422, 424, 426, 428, from which in-track and cross-track color plane registration shifts and the in-track and cross-track dimensional changes can be determined on a document-by-document basis.

The registration shifts and the dimensional changes can be corrected for using any method known in the art. In an exemplary embodiment, in-track registration shifts can be corrected by changing the cue delay for the associated color plane 400. Similarly, cross-track registration shifts can be corrected by causing the print data of a color plane 400 to be shifted so that it is printed by different jets.

Cross-track width corrections (cross-track magnification adjustments) can be implemented by selectively inserting or removing pixels in the data stream supplied to a printhead for the printing of a single line or row of pixels. One method for doing this is described in commonly-assigned U.S. Pat. No. 8,760,712 to Enge et al., entitled "Modifying print data using matching pixel patterns," which is incorporated herein by reference.

Figure 5:
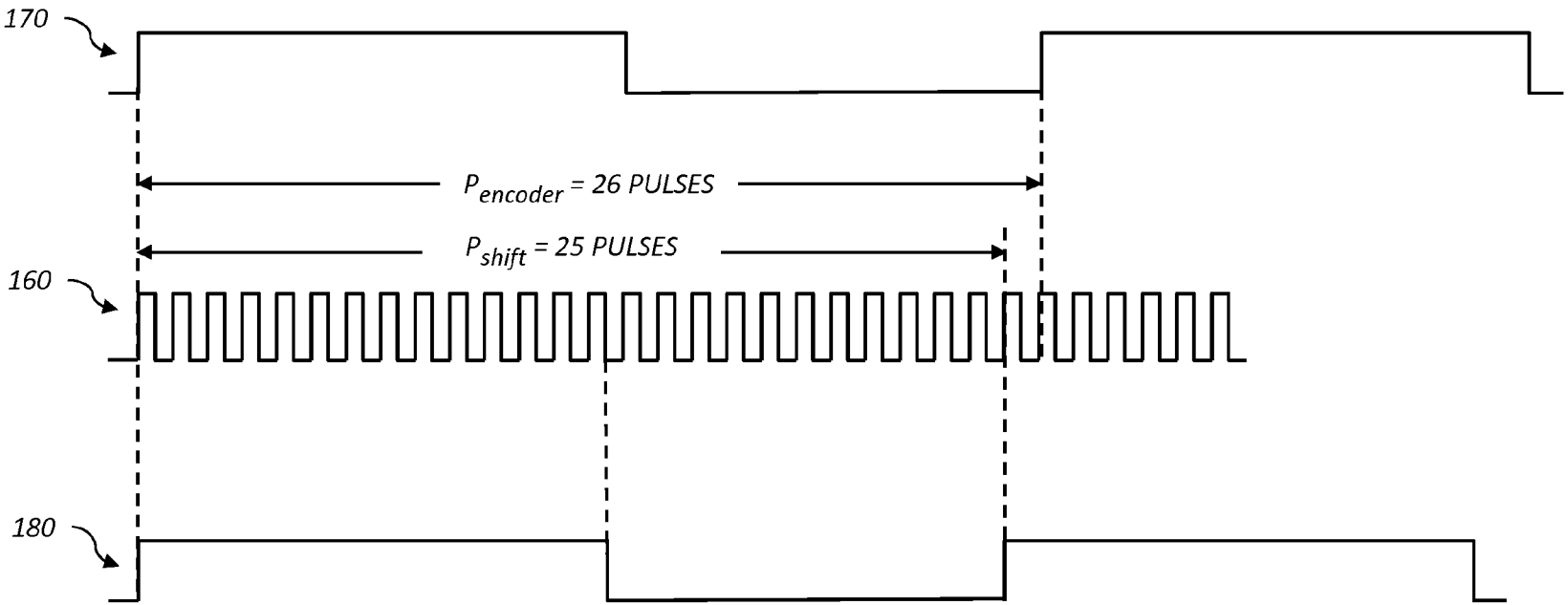
FIG. 5 is a diagram illustrating a frequency shifted pulse stream.

In-track length corrections (in-track magnification adjustments) can be carried out by frequency shifting the encoder pulse stream supplied to one or more of the printheads. An exemplary process for frequency shifting the encoder pulse stream is disclosed in commonly-assigned U.S. Pat. No. 8,123,326, to Saettel et al., entitled "Calibration system for multi-printhead ink systems," which is incorporated herein by reference. This method is illustrated in FIG. 5. The clock pulse stream 160 is generated by a system clock, which maintains a constant pulse frequency so that other components of the system can have a timing mechanism. The top pulse stream is the encoder pulse stream 170 from the encoder 122 (FIG. 2). The period, or time between pulses, $P_{encoder}$, can be measured by counting the number of system clock pulses in the clock pulse stream 160 (either the number of rising or falling edges) between pulses. In this example, the period is measured from one rising edge of the encoder pulse stream 170 to the next to yield a count of $P_{encoder}=26$ system clock pulses of the clock pulse stream 160. If the encoder pulses in the encoder pulse stream 170 have a 50% duty cycle, where pulse high time equals the pulse low time, the number of system clock pulses between rising and falling edges of the pulses gives a measurement of half the pulse period. (In practice it is desirable to average together several measurements of the period to reduce the counting statistic noise.)

A new frequency-shifted pulse stream 180 is then created with a new frequency-shifted period, $P_{shift}$, which is equal to the measured period times a correction factor that is based on the determined in-track magnification error factor (CF): $P_{shift}=P_{encoder}*CF$. In this example, a correction factor CF of 0.96 yields a period for the frequency-shifted pulse stream 180 of $P_{shift}=26*0.96=25$ system clock pulses. The frequency-shifted pulse stream 180 can then be created by forming pulses that are separated by 25 system clock pulses. This change will decrease slightly the spacing of the pixels for the second printhead so that the second image plane, printed by the second printhead will gradually shift up toward alignment with the first image plane. If no error is detected the magnification correction factor (CF) will equal 1.0 so that the period $P_{shift}$ of the frequency-shifted pulse stream 180 is equal to the period $P_{encoder}$ of the encoder pulse stream 170. To reduce errors produced by noise or jitter in the measurement of the encoder pulse period $P_{encoder}$, the value of $P_{encoder}$ can be an average value determined by averaging several measurements of the period.

Returning to a discussion of FIG. 2, to further improve the registration of the black color plane with the previously-printed color planes, a second encoder 128 associated with a roller 132 in closer proximity to the black printhead 106*k* is used to control the timing of printing using the black printhead 106*k*, while upstream encoder 122 is used to control the timing of the print from the other color printheads 106*c*, 106*m*, and 106*y*. As downstream encoder 128 is more closely spaced relative to the black printhead than the upstream encoder 122, encoder 128 more closely tracks the motion of the print medium 112 at the black printhead 106*k* than the encoder 122.

In a preferred configuration, a first one of the two encoders 122, 128 is defined to be the reference encoder, typically the upstream encoder 122, and the second encoder, typically the downstream encoder 128 is frequency shifted so that initially its average pulse rate matches the average pulse rate of the first encoder. For example, the frequency-shifting method discussed above with respect to FIG. 5 can be used in this application as well. The average pulse rates for each encoder 122, 128 are determined by separately counting encoder pulses from each encoder for some defined sampling interval. In a preferred embodiment, the sampling interval corresponds to the time for printing a specified number of documents (preferably at least 10 documents, and more preferably about 50 documents). The ratio of these pulse counts is then used as the frequency shifting scaling factor. By using a sampling interval that is much larger than the print time of a single document, the sampling errors are reduced and the measured pulse rates for each encoder 122, 128 are less sensitive to variations in ink coverage which can cause local localized dimensional changes in the print medium 112.

For high quality prints, not only must the different color planes be well registered, but also the print swaths of each of the jetting modules in each printhead must be registered or stitched together to produce a printed image without obvious seams between print swaths. Commonly-assigned U.S. Pat. No. 7,871,145 to Enge, entitled "Printing method for reducing stitch error between overlapping jetting modules," which is incorporated herein by reference, discloses an effective method for stitching the print swaths together. During setup and stitching tests for a print run, an image quality (IQ) camera can be used to check the stitching of first and second rows of jetting modules in each printhead as described in commonly-assigned U.S. Pat. No. 8,842,331, to Enge, entitled "Multi-print head printer for detecting alignment errors and aligning image data reducing swath boundaries," which is incorporated herein by reference. The control system (e.g., processor 118 of FIG. 1) determines an appropriate encoder pulse count delay $n_j$ for the $j^{th}$ jetting module 200 in a particular printhead 106*c*, 106*m*, 106*y*, 106*k* relative to a particular reference jetting module 200 in that printhead. This encoder pulse count delay can also be referred to as a stitching encoder pulse count delay to differentiate it from the registration encoder pulse count delay described earlier. In an exemplary embodiment, the stitching encoder pulse count delays for each jetting module 200 of the cyan, magenta, and yellow printheads 106*c*, 106*m*, 106*y* relative to the reference jetting module in that printhead are counted out using the pulse stream of the upstream encoder 122, while the stitching encoder pulse count delays for jetting modules 200 of the black printhead 106K are counted out using the pulse stream of the downstream encoder 128. The setup and stitching tests tend to involve low ink coverage test patterns printed at low speeds and with the dryer off.

In high speed inkjet printing, the print medium 112 is typically dried using dryers 108. The dryers 108 transfer heat to the ink and the print medium 112 by one or more of radiant energy, contact with a heated surface, or directing heated air at the print medium 112. As a result, the print medium 112 leaves the dryers 108 at temperatures well above ambient temperature. The hot print medium 112 transfers heat to the media path rollers downstream of the dryers 108, including the downstream encoder roller 132. This causes the downstream encoder roller 132 to thermally expand, and distances measured out per encoder pulses from the downstream encoder 128 to increase. As the downstream encoder 128 is used in the control of the black printhead 106*k*, the thermal expansion of the downstream encoder roller 132 can affect the in-track registration, the document length, and the jetting-module-to-jetting-module stitching of the black color plane.

The in-track registration and the document length are continuously monitored by IQ cameras (e.g., quality control sensor 110 in FIG. 2), which capture images of the registration marks 410, 412, 414, 416, 422, 424, 426, 428 (FIG. 4) printed along each side of the printed documents 418, 420. Based on the measured registration mark positions, adjustments can be made to compensate for in-track registration shifts and in-track dimensional changes that are induced by thermal expansion of the encoder roller 132, as well as from other sources such as media stretch or shrinkage. As a result, thermal expansion of the encoder roller 132 generally does not result in a visible degradation of the color-to-color registration. However, the IQ cameras, which are positioned at the color to color registrations marks, are typically not positioned where they can detect changes in the jetting module stitching during the operation of the printer. While IQ cameras could be positioned at each of the stitching location, the addition of such IQ cameras would add significant cost.

Figure 6:
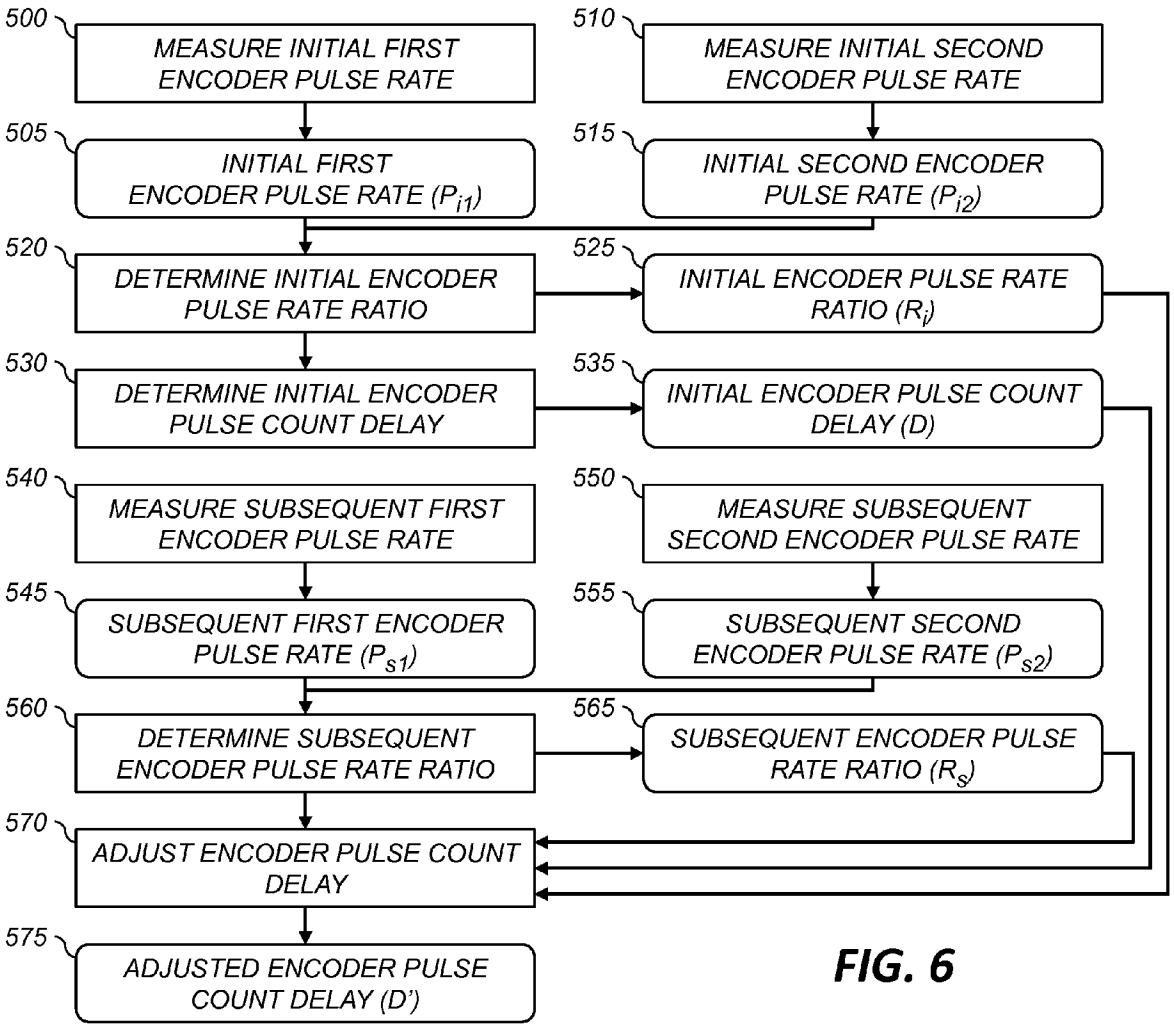
FIG. 6 illustrates a flow chart for providing adjusted pulse count delays.

FIG. 6 illustrates a flow chart of a process that is used to correct for the impact that thermal expansion of the downstream encoder roller 132 can have on pulse count delays that are used to correct for artifacts such as jetting module stitching errors according to an exemplary embodiment. The steps of this process are typically performed automatically under the control of a data processor such as processor 118.

First, a measure initial first encoder pulse rate step 500 is used to determine an initial first encoder pulse rate 505 for the first upstream encoder 122 (FIG. 2) during setup test and stitching tests performed at the start of printing. Similarly, a measure initial second encoder pulse rate step 510 is used to determine an initial second encoder pulse rate 515 for the second downstream encoder 128 (FIG. 2). The encoder pulse rates can be characterized using a variety of different metrics. Generally, the encoder pulse rates will be expressed in terms of the number of encoder pulses in some time interval, such as the time it takes for a predefined number of cue marks 320 (FIG. 3) to pass the cue sensor 124.

Next, a determine initial encoder pulse rate ratio step 520 is used to determine an initial encoder pulse rate ratio 525 ($R_i$) of the initial first encoder pulse rate 505 ($P_{i1}$) relative to the initial second encoder pulse rate 515 ($P_{i2}$):

$$R_i=P_{i1}/P_{i2}. \tag{1}$$

A determine initial encoder pulse count delay step 530 is performed during setup test and stitching tests performed at the start of printing to determine an initial encoder pulse count delay 535 (D), where the encoder pulse count delay is used in the process of aligning image content between different color planes 400, 402 (FIG. 4) or jetting modules 200 (FIG. 2) as has been discussed earlier. In an exemplary embodiment, the initial encoder pulse count delay 535 represents the stitching encoder pulse count delay necessary to properly align image data printed by different jetting modules 200 within a printhead in order to eliminate visible stitching artifacts. In some embodiments, the determine initial encoder pulse count delay step 530 uses an iterative process to adjust the pulse count delay while using a properly positioned IQ camera to monitor the alignment of the image data printed by adjacent jetting modules 200 until a pulse count delay that eliminates stitching artifacts is identified.

After the printing has begun, subsequent encoder pulse rate measurements are performed to monitor any drift in the relative encoder pulse rates due to sources such as thermal expansion of the rollers. In particular, a measure subsequent first encoder pulse rate step 540 is used to determine a subsequent first encoder pulse rate 545 for the first upstream encoder 122 (FIG. 2), and a measure subsequent second encoder pulse rate step 550 is used to determine a subsequent second encoder pulse rate 555 for the second downstream encoder 128 (FIG. 2).

A determine subsequent encoder pulse rate ratio step 560 is then used to determine a subsequent encoder pulse rate ratio 565 ($R_s$) of the subsequent first encoder pulse rate 545 ($P_{s1}$) relative to the subsequent second encoder pulse rate 555 ($P_{s2}$):

$$R_s=P_{s1}/P_{s2}. \tag{2}$$

In some cases, the print media speed is substantially unchanged between the initial and the subsequent pulse rate measurements, so that the first encoder pulse rate remains effectively constant between the initial and the subsequent measurements. In such cases, it may not be necessary to measure the subsequent first encoder pulse rate 545, and the initial first encoder pulse rate 505 can be compared to the subsequent second encoder pulse rate 555 to determine the subsequent encoder pulse rate ratio 565.

An adjust encoder pulse count delay step 570 is then used to modify the initial encoder pulse count delay 535 (D) in accordance with any drift in the relative encoder pulse rates. In an exemplary embodiment, a correction factor ($F_c$) is determined by computing a ratio between the initial encoder pulse rate ratio 525 ($R_i$) and the subsequent encoder pulse rate ratio 565 ($R_s$):

$$F_c=R_s/R_i. \tag{3}$$

An adjusted encoder pulse count delay 575 (D') can then be determined by using the correction factor ($F_c$) to modify the initial encoder pulse count delay 535 (D):

$$D'=F_c\times D=(R_s/R_i)\times D. \tag{4}$$

In an exemplary configuration, the adjusted encoder pulse count delay 575 is a stitching encoder pulse count delay to be applied for the $j^{th}$ jetting module of the black printhead 106*k* (FIG. 2). In this case, the process of FIG. 6 can be used to determine adjusted encoder pulse count delays 575 ($D'_j$) for each jetting module j. For example, if the downstream encoder roller 132 has expanded, the pulse rate of the downstream encoder 128 will drop relative to that of the upstream encoder 122, resulting in a smaller subsequent encoder pulse rate ratio 565 ($R_s$). The correction factor $F_c$ will therefore be less than 1.0, and the adjusted encoder pulse count delay 575 ($D'_j$) will be smaller than the initial encoder pulse count delay 535 ($D_j$) to account for the fact that fewer encoder pulses will be detected as the print medium 112 advances the desired distance. In this way the stitching errors of the jetting modules 200 in the black printhead 106*k* are reduced, compensating for changes in the diameter of the encoder roller 132.

The thermal expansion of the downstream roller encoder is not the only mechanism by which the subsequent encoder pulse rate ratio ($R_s$) can be impacted. There can also be changes in the effective diameter of the encoder roller 132 due how the print medium 112 interacts with the encoder roller 132. In an exemplary embodiment of the printing system, the downstream encoder roller 132 has a grooved concave profile as described in commonly-assigned U.S. Pat. No. 8,876,277 to Vandagriff et al., entitled "Vacuum pulldown of a print media in a printing system," which is incorporated herein by reference. Changes in the stiffness and width of the print medium 112 caused by printing on the print medium 112 can affect the interaction of the print medium 112 with the grooved concave roller, which can affect the subsequent encoder pulse rate ratio ($R_s$). There can also be changes in the slip characteristics between the print medium 112 and the encoder roller 132 due to temperature changes and changes in the properties of the print medium 112 due to ink and heat. The adjusted encoder pulse count delay 575 of the invention helps compensate for these changes as well.

In a preferred embodiment, the subsequent encoder pulse rates are repeatedly measured and the adjusted encoder pulse count delay 575 is determined and repeatedly updated during printing. This enables the system to continue to compensate for changes in the encoder roller diameter due to changes in the temperature of the encoder roller 132.

Both the initial encoder pulse rate measurements and the subsequent encoder pulse rate measurements are preferably carried out by counting the number of encoder pulses during a defined sampling interval. The sampling interval for the subsequent encoder pulse rate measurements can be of the same duration as the sampling interval for the initial encoder pulse rate measurements, or alternatively it can be different. In a preferred embodiment, the sampling interval for the initial encoder pulse rate measurements corresponds to the time required for 50 cue marks 320 (FIG. 3) to pass the cyan printhead 106*c*, and the sampling interval for the subsequent encoder pulse rate measurements corresponds to the time required to 25 cue marks 320 to pass the cyan printhead 106*c*. The shorter sampling interval for the subsequent encoder pulse rate measurements enables the adjusted encoder pulse count delay 575 to be updated more frequently. Preferably, while printing, as soon as one sampling interval is completed a new sampling interval is begun.

Alternatives to such the periodic encoder pulse rate measurements and adjusted encoder count delay readjustments include making the encoder pulse rate measurements and encoder count delay adjustments whenever the temperature of the downstream encoder roller is found to have changed by more than a threshold amount, or whenever the measurements of the in-track magnification average for some number of documents is found to change by some threshold amount.

It is desirable for the sampling interval for the subsequent encoder pulse rate measurements to be long enough that any fluctuations in the downstream encoder count produced by ink coverage dependent in-track stretch of the print medium 112 in the different documents are averaged out. When printing books or other documents having a repeated sequence of M print pages, an alternative sampling interval corresponds to an integer number of copies of the M pages. By using such a sampling interval, one ensures that the count rate between the upstream and the downstream encoders is not affected by the print content of the particular sampling interval.

As successive measurements of the encoder counts are made, various statistical tests can be run to validate the measurements before applying the correction factor determined from the measurements to adjusting the encoder pulse count delay. For example, the encoder count of the upstream encoder can be compared to previous upstream encoder counts. As the upstream encoder undergoes little change in temperature since it is located upstream of any dryers 108 (FIG. 2), the upstream encoder count should remain fairly constant. Therefore if the upstream encoder count varies by more than a threshold amount from the preceding value, the measurement might be considered invalid. Various other statistical tests can also be used to check for outliers that shouldn't be used for adjusting the encoder pulse count delay. In other embodiments, successively determined subsequent encoder pulse rate ratios 565 or correction factors $F_c$ are averaged together in some way such as a multi-point moving average to produce a lower noise correction.

Figure 7:
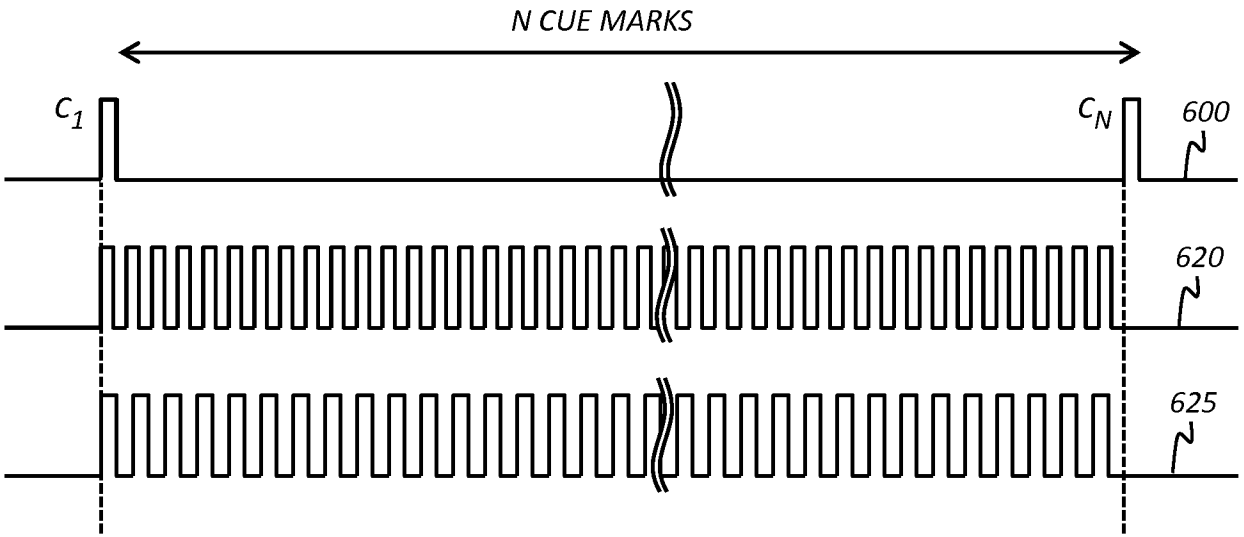
FIG. 7 illustrates a concurrent sampling interval method for measuring of a first encoder pulse rate and a second encoder pulse rate.

In an exemplary embodiment, the encoder pulse rate measurements (both initial and subsequent) for both encoders 122, 128 are concurrently measured during a sampling interval corresponding to a defined number of cue marks (e.g., N=25) being detected by the upstream cue sensor 126 near the cyan printhead 106*c*, or a defined number of cue marks being printed by the cyan printhead 106*c*. This encoder rate testing process is called a concurrent sampling interval method, and it ensures that the encoder counts all correspond to the same time interval. This approach is illustrated in FIG. 7. A cue pulse stream 600 illustrates the signal from the cue sensor 126. The upstream encoder pulse stream 620 shows the signal from the upstream encoder 122, and the downstream encoder pulse stream 625 shows the signal from the downstream encoder 128. The sampling interval corresponds to a defined number of cue marks being detected in the cue pulse stream 600, where the cue mark spacing typically corresponds to the document spacing or length. The upstream and downstream encoder pulse rates are determined by counting the number of encoder pulses in the upstream encoder pulse stream 620 and the downstream encoder pulse stream 625, respectively, that are detected during the time it takes for N cue marks to be detected in the cue pulse stream 600.

Figure 8:
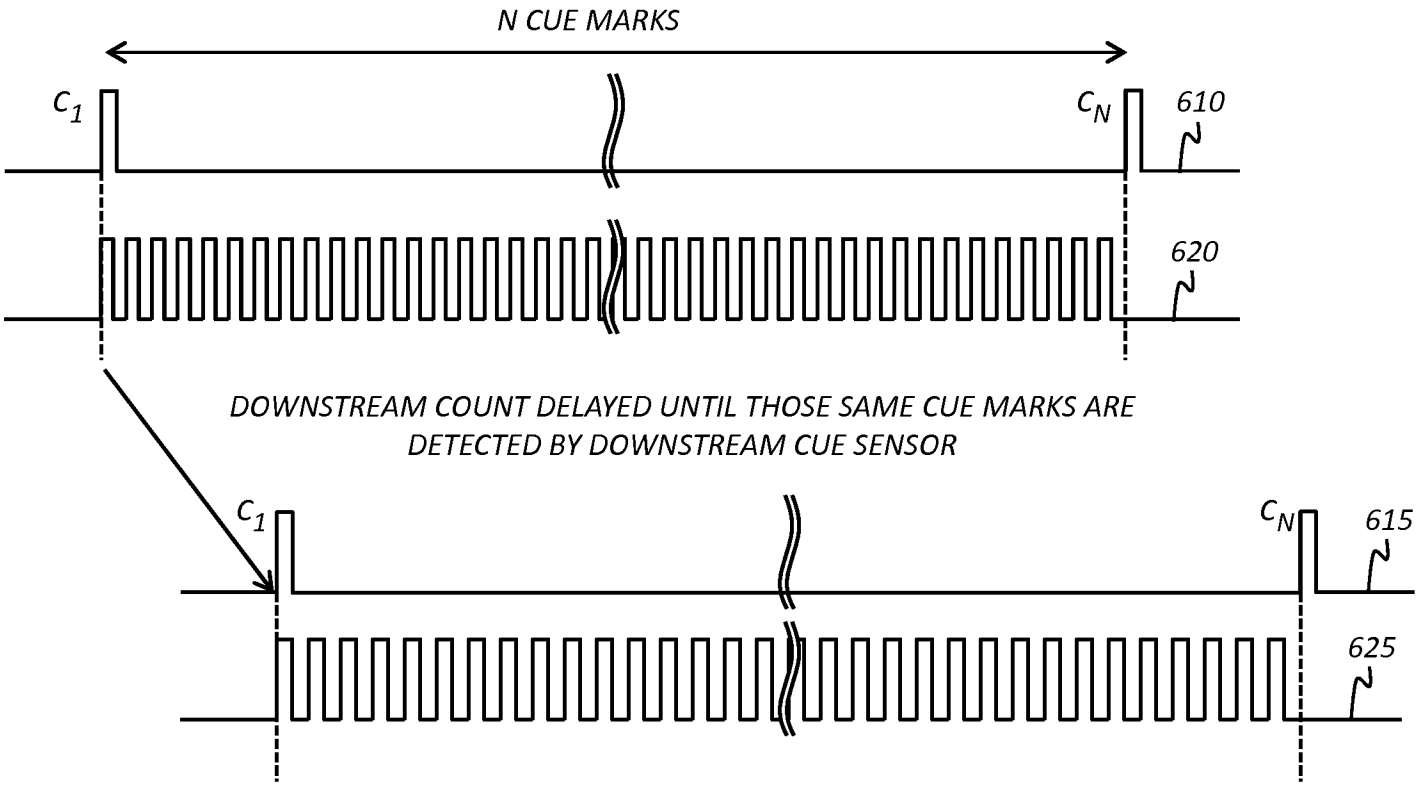
FIG. 8 illustrates a staggered sampling interval method for measuring of a first encoder pulse rate and a second encoder pulse rate.

FIG. 8 illustrates an alternate configuration which uses staggered sampling intervals to determine the encoder pulse rates for each encoder 122, 128. In this case, the sampling interval for the upstream encoder 122 starts when a particular cue mark ($C_1$) is detected in an upstream cue pulse stream 610, and finishes N cue signals (i.e., at cue mark $C_N$). The upstream cue pulse stream 610 can be a signal from the upstream cue sensor 126, or can correspond to the time where cue marks are printed by an upstream printhead (e.g., cyan printhead 106*c*). The sampling interval to determine the downstream encoder pulse rate starts when the same cue mark ($C_1$) has traveled down the media transport path and is detected in a downstream cue pulse stream 615 from the downstream cue sensor 124, and finishes N cue signals later (i.e., when the cue mark $C_N$ is detected by the downstream cue sensor 124). This alternate approach ensures that encoder counts are measured for the passage of the same 50 cue mark segment of print medium 112 past the cue sensor 124, 126 nearest each encoder 122, 128. This alternative is called a staggered sampling interval method.

In an alternate approach, the sampling interval could be defined by a fixed interval of time rather than by a fixed number of documents or a fixed length of print media passing a location along the media transport path. However the use of a fixed time interval causes the pulse rate measurement sampling statistics to vary depending on the speed at which the media is passing through the printing system.

The measurements of the initial encoder pulse rates are typically done while printing a setup test pattern at low print speed and low ink coverage, while the dryer is not energized. The subsequent measurements of the encoder pulse rates are typically carried out while printing the product print job with variable ink coverage while printing at high speeds (high print media velocity). In some embodiments, following the initial measurements of the encoder pulse rates from the first and the second encoders 122, 128, the encoder pulse rate from either the first or the second encoder 122, 128 is frequency shifted prior to determination of the initial encoder pulse count delay so that the pulse rates of the first and the second encoders 122, 128 match. In such cases, the initial ratio of the first and the second encoder pulse rates $R_i$ equals 1.0, so the correction factor becomes $F_c=R_s$.

The printing of images while using the adjusted pulse count delays enables the stitching of print swaths to print images without visible stitching artifacts. Typically, the encoder pulse count delays and adjusted pulse count delays are counted out using the pulse streams from the encoders prior to the application of in-track magnification corrections to these pulse streams. This ensures that the in-track stitching isn't influenced both by the adjustment of the pulse count delays and by changes in the in-track magnification.

While the exemplary configuration described herein has focused on determining adjusted encoder pulse count delays for aligning the image data printed by different jetting modules 200 in a downstream printhead 106*k* controlled by a downstream encoder 128, one skilled in the art will recognize that the same approach can be used to adjust encoder pulse count delays that are used for other purposes as well. For example, the adjusted encoder pulse count delays can be used to control the timing for the printing of image data by the downstream printhead 106*k* relative to the detection of a cue mark 320 or relative to the printing of image data by an upstream printhead 106*c*. In this case, the encoder pulse count delay is the registration encoder pulse count delay. The initial encoder pulse count delay corresponds to the initial registration encoder pulse count delay, and the adjusted encoder pulse count delay is an adjusted registration encoder pulse count delay. This can provide reduced alignment errors between the image data printed by the different printheads 106*c*, 106*m*, 106*m*, 106*k*. Generally any operation that is controlled using a pulse count delay relative to the encoder pulse stream for the downstream encoder 128 can be adjusted using the described method in order to provide improved consistency with operations that are controlled relative to the encoder pulse stream for the upstream encoder 122.

The invention has been described in detail with particular reference to certain preferred embodiments thereof, but it will be understood that variations and modifications can be effected within the spirit and scope of the invention.

PARTS LIST

100 printing system
102 first printing module
104 second printing module
106*c* printhead
106*k* printhead
106*m* printhead
106*y* printhead
108 dryer
110 quality control sensor
112 print medium
114 transport direction
116 turnover module
118 processor
120 storage device
122 encoder
124 cue sensor
126 cue sensor
128 encoder
130 roller
132 roller
160 clock plus stream
170 encoder pulse stream
180 frequency-shifted pulse stream
200 jetting module
202 nozzle array
204 support structure
210 reference line
212 reference line
214 reference line
216 reference line
218 reference line
220 reference line
300 print job
302 document page
304 image plane
306 image plane
308 image plane
310 image plane
320 cue mark
400 color plane
402 color plane
404 in-track direction
406 cross-track direction
410 registration mark
412 registration mark
414 registration mark
416 registration mark
418 document
420 document
422 registration mark
424 registration mark
426 registration mark
428 registration mark
500 measure initial first encoder pulse rate step
505 initial first encoder pulse rate
510 measure initial second encoder pulse rate step
515 initial second encoder pulse rate
520 determine initial encoder pulse rate ratio step
525 initial encoder pulse rate ratio
530 determine initial encoder pulse count delay step
535 initial encoder pulse count delay
540 measure subsequent first encoder pulse rate step
545 subsequent first encoder pulse rate
550 measure subsequent second encoder pulse rate step
555 subsequent second encoder pulse rate
560 determine subsequent encoder pulse rate ratio step
565 subsequent encoder pulse rate ratio
570 adjust encoder pulse count delay step
575 adjusted encoder pulse count delay
600 cue pulse stream
610 upstream cue pulse stream
615 downstream cue pulse stream
620 upstream encoder pulse stream
625 downstream encoder pulse stream

The invention claimed is:

1. A method for adjusting an encoder pulse count delay in a printing system for printing on a continuous web of print media, comprising:

providing a first printhead at a first printhead position along a media transport path, the first printhead being adapted to print ink drops onto the print media as the print media travels along the media transport path past the first printhead position;

providing a second printhead at a second printhead position along the media transport path, the second printhead being adapted to print ink drops onto the print media as the print media travels along the media transport path past the second printhead position;

providing a first encoder at a first encoder position along the media transport path, the first encoder generating a first encoder pulse stream having a first encoder pulse rate, each pulse in the first pulse stream indicating the passage of a first defined length of print media past the first encoder position, wherein the first pulse stream controls a timing for printing of ink drops from the first printhead;

providing a second encoder at a second encoder position along the media transport path, the second encoder generating a second encoder pulse stream having a second encoder pulse rate, each pulse in the second pulse stream indicating the passage of a second defined length of print media past the second encoder position, wherein the second pulse stream controls a timing for printing of ink drops from the second printhead;

determining an initial ratio of the first encoder pulse rate to the second encoder pulse rate;

providing an initial encoder pulse count delay for use in printing with the second printhead;

controlling the first printhead responsive to the first encoder pulse stream to print ink drops on the print media in accordance with image data for a first image plane of a first printed image;

controlling the second printhead responsive to the second encoder pulse stream and the initial encoder pulse count delay to print ink drops on the print media in accordance with image data for a second image plane of the first printed image;

determining a subsequent ratio of the first encoder pulse rate to the second encoder pulse rate;

using a processor to determine an adjusted encoder pulse count delay by adjusting the initial encoder pulse count delay responsive to the initial ratio and the subsequent ratio;

controlling the first printhead responsive to the first encoder pulse stream to print ink drops on the print media in accordance with image data for a first image plane of a second printed image;

controlling the second printhead responsive to the second encoder pulse stream and the adjusted encoder pulse count delay to print ink drops on the print media in accordance with image data for a second image plane of the second printed image.

2. The method of claim 1, wherein the second printhead includes a first jetting module and a second jetting module for printing ink drops onto the print media, the printing from the second jetting module being delayed relative to the printing from the first jetting module as a function of the encoder pulse count delay.

3. The method of claim 1, wherein the printing of ink drops by the second printhead is delayed relative to the detection of a cue mark on the print media by a cue sensor as a function of the encoder pulse count delay.

4. The method of claim 1, wherein the printing of image data by the second printhead is delayed relative to the printing of corresponding image data by the first printhead as a function of the encoder pulse count delay.

5. The method of claim 1, wherein the encoder pulse count delay is used to control an alignment between the printed image data for the second image plane and the printed image data for the first image plane.

6. The method of claim 1, wherein determining the ratio of the first encoder pulse rate to the second encoder pulse rate includes:

measuring a first encoder pulse rate based on the first pulse stream;

measuring a second encoder pulse rate based on the second pulse stream; and using a processor to compute a ratio of the measured first encoder pulse rate to the measured second encoder pulse rate.

7. The method of claim 6, wherein the first and second encoder pulse rates are measured by counting a number of encoder pulses in the respective first and second pulse streams during a defined sampling interval.

8. The method of claim 7, wherein the sampling interval is a fixed time interval.

9. The method of claim 7, wherein a cue sensor is used to detect cue marks on the print media as the print media is advanced along the media transport path past the cue sensor, and wherein the sampling interval is the time difference between detecting a first cue mark on the print media and detecting a second cue mark on the print media.

10. The method of claim 7, further including using the first printhead to print a sequence of cue marks on the print media, wherein the sampling interval is the time difference between printing a first cue mark on the print media and printing a second cue mark on the print media.

11. The method of claim 1, further including periodically determining an updated ratio of the first encoder pulse rate to the second encoder pulse rates and adjusting the encoder pulse count delay in response to the updated ratio.

12. The method of claim 1, wherein the second encoder includes an encoder roller that contacts the print media, and wherein the second encoder provides a predefined number of encoder pulses for each revolution of the encoder roller.

13. The method of claim 12, wherein the second encoder pulse rate varies over time responsive to thermally-induced changes in a diameter of the encoder roller.

14. The method of claim 1, wherein the adjusted encoder pulse count delay D' is given by:

$$D'=(R_s/R_i)\times D$$

where D is the initial encoder pulse count delay, $R_i$ is the initial ratio of the first encoder pulse rate to the second encoder pulse rate, and $R_s$ is the subsequent ratio of the first encoder pulse rate to the second encoder pulse rate.

15. The method of claim 1, further including shifting the frequency of the pulses in the second encoder pulse stream so that the second encoder pulse rate associated with the second encoder pulse stream matches the first encoder pulse rate associated with the first encoder pulse stream.

* * * * *